US005354966A

United States Patent [19]

Sperbeck

[11] Patent Number: 5,354,966

[45] Date of Patent: Oct. 11, 1994

[54] WINDOW DEFOGGING SYSTEM WITH OPTICALLY CLEAR OVERLAY HAVING MULTI-LAYER SILVER BUS BARS AND ELECTRICALLY ISOLATING PERIPHERAL GROOVES

[76] Inventor: Scott W. Sperbeck, 20007 - 45th Drive S.E., Bothell, Wash. 98012

[21] Appl. No.: 189,958

[22] Filed: Jan. 31, 1994

Related U.S. Application Data

[63] Continuation-in-part of Ser. No. 801,278, Dec. 2, 1991, abandoned.

[51] Int. Cl.[5] ..... H05B 3/00

[52] U.S. Cl. ..... 219/203; 219/522

[58] Field of Search ..... 219/203, 522, 543; 338/308, 309; 15/250.05

[56] References Cited

U.S. PATENT DOCUMENTS

| | | | |
|---|---|---|---|
| 2,640,904 | 6/1953 | Gaiser | 219/522 |
| 3,024,341 | 3/1962 | Ogle, Jr. et al. | 219/522 |
| 3,330,942 | 7/1967 | Whitson | 219/541 |
| 3,718,535 | 2/1973 | Armstrong et al. | 219/203 |
| 3,878,361 | 4/1975 | Levin et al. | 219/522 |
| 3,982,092 | 9/1976 | Marriott | 219/203 |
| 4,584,721 | 4/1986 | Yamamoto | 219/203 |
| 4,682,007 | 7/1987 | Hollander | 219/203 |
| 4,878,850 | 11/1989 | Letemps et al. | 219/203 |
| 4,952,783 | 8/1990 | Aufderheide et al. | 219/543 |
| 5,119,467 | 6/1992 | Barsky et al. | 219/543 |

*Primary Examiner*—Bruce A. Reynolds
*Assistant Examiner*—John A. Jeffery
*Attorney, Agent, or Firm*—Christensen, O'Connor, Johnson & Kindness

[57] ABSTRACT

A window defogging system that comprises a power supply and an optically clear overlay includes a sheet of heat-stabilized polyester (13) having a hard coat layer (15) on one surface and an indium tin oxide (ITO) layer (17) on the other surface. The ITO layer (17) is scored around its periphery (19) to create a groove that electrically isolates the edge of the ITO layer from an interior heating zone (23). Additional grooves create electrically isolated regions (26*a*, 26*b*, 28*a* and 28*b*). Multiple layers of silver are printed atop the ITO layer (17), along opposing edges of the interior (heater) zone (23), to create bus bars (25*a*, 25*b*). The bus bars end at terminal regions (29*a*, 29*b*) that are connected directly to the power supply. The housing (61) of the power supply is supported by connectors mounted in the optically clear overlay. In some versions of the invention, a dielectric layer (33*a*, 33*b*) is located along a portion of the bus bars, between the multiple layers of silver. The power supply includes a temperature-sensing device, e.g., a thermistor, that senses the temperature of the interior zone and uses this information to control the application of power to the ITO layer via the bus bars.

23 Claims, 6 Drawing Sheets

WINDOW DEFOGGING SYSTEM WITH OPTICALLY CLEAR OVERLAY HAVING MULTI-LAYER SILVER BUS BARS AND ELECTRICALLY ISOLATING PERIPHERAL GROOVES

CROSS-REFERENCE TO OTHER APPLICATIONS

This application is a continuation-in-part of U.S. application Ser. No. 07/801,278, filed Dec. 2, 1991, now abandoned and entitled HEATED WINDOW SYSTEM. The subject matter of application Ser. No. 07/801,278 is incorporated herein by reference.

TECHNICAL AREA

This invention is related to window defogging systems and, more particularly, to heating systems for defogging and defrosting windows and the like.

BACKGROUND OF THE INVENTION

It is well known that windows can be defogged by applying heat to the windows. Most modern automobiles include a rear window defogger that removes fog, frost and ice from the rear window of the automobile by applying heat to the window. Heat is normally produced by applying an electric voltage to a pair of bus bars located on opposite sides of the window. The bus bars are joined by a plurality of thin wires that extend across the window. While wire-type rear window defoggers have found widespread use in automobiles, they have not proved to be entirely satisfactory in other environments, particularly rugged environments. One such environment is boats, particularly commercial boats used in cold climates, such as Alaska.

One of the major disadvantages of wire-type window defoggers is their fragile nature. Wire-type window defoggers are supported by a thin sheet applied to the window to be defogged. As a result, the wires of such defoggers are easily broken when an object is slid across the surface of the window on which the defogger is located. Such fragility is acceptable in connection with the rear window of an automobile since objects are seldom slid across the surface of such windows. It is not acceptable in rough environments, such as on board a commercial fishing vessel.

In the past, heaters formed of a layer of indium tin oxide (ITO) on a substrate have been proposed. In addition to being proposed for use as incubator heaters (see U.S. Pat. No. 5,119,467), they have also been proposed for use as display heaters (see U.S. Pat. No. 4,952,783). Further, thin film heaters have been proposed for use in motor cycle helmet defoggers (see U.S. Pat. No. 4,584,721).

In the past, ITO heaters have not been entirely satisfactory when proposed for use in defogging relatively large surfaces, such as the windows of a fishing vessel. One of the major difficulties with ITO heaters has been the difficulty of applying power to a large area of ITO in a manner that creates uniform heating. In the past, the heat generated at different locations of an ITO layer has varied dramatically. The heat generated near the power input end of bus bars applying power to the ITO layer has been significantly greater than the heat generated at the other end of the bus bars. The temperature differential has required either increasing the power applied to the bus bars or accepting the fact that while a portion of a window may be defrosted or defogged, other portions may not be defrosted or defogged. Obviously, defrosting or defogging only a portion of a window is an unsatisfactory solution. Increasing the power to bus bars has, in the past, resulted in the overheating and destruction of the bus bars. Shorts have also created problems. Further, because, in the past, power control circuitry has been remote from the location of the ITO heat generating layer, temperature sensing and response time have also been unsatisfactory. Also, problems have been encountered in applying a substrate supporting an ITO layer to a window, particularly as an after market product.

The present invention is directed to providing a window defogging system that overcomes the foregoing disadvantages.

SUMMARY OF THE INVENTION

In accordance with this invention a window defogging system is provided. The window defogging system comprises a power supply and an optically clear overlay. The optically clear overlay includes a sheet of heat-stabilized polyester having a hard coat layer on one surface and an indium tin oxide (ITO) layer on the other surface. The edge of the ITO layer is electrically isolated from an interior heating zone. The interior heating zone of the ITO layer can be electrically isolated by scoring a groove around the periphery of the ITO layer. Alternatively, acid etching can be used to remove a part of the ITO layer around the periphery of the ITO layer. Scoring, acid etching or dielectric layers are used to isolate selected regions of the ITO layer from the interior heating zone. Multiple layers of silver are printed atop the ITO, along opposing edges of the interior heating zone to create bus bars. The bus bars terminate at terminals that are connected directly to a power supply that is mounted in a housing supported by the overlay. Because the power supply housing is directly mounted on the optically clear overlay, temperature-sensing devices that form part of the power supply quickly sense changes in the a temperature of the ITO layer. As a result, the power supply can quickly increase or decrease the current applied to the bus bars, as required. The multiple layers of silver create a relatively thick bus bar that carries current from one end of the ITO layer to the other end without a significant voltage drop occurring.

In accordance with other aspects of this invention, a dielectric layer is located along a portion of the bus bars, between the multiple layers of silver. As a result, power is applied to both ends of the bus bars, rather than just one end, minimizing the voltage drop along the length of the bus bar.

In accordance with still further aspects of this invention, after the bus bars are created on the ITO, prior to applying an adhesive to the ITO layer for attaching the ITO layer directly to a window, the terminal regions of the bus bars are covered with a mask. Thereafter, the adhesive layer is created atop the ITO layer. Then, the region around the terminating ends of the bus bar is die cut to create flaps in the adhesive layer. Holes are created in the terminating ends of the bus bars and, preferably, in other areas of the optically clear overlay. Terminals are added by raising the flaps, installing the terminals and then lowering the flaps. The end result is a direct connection between the terminals and the terminal ends of the bus bars. In addition to providing an electrical connection to the bus bars, the terminals provide support for the power supply housing. Preferably, vent holes are created in the region of the terminals to allow air and fluids to vent when the optically clear overlay is applied to a window.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Figure 3:
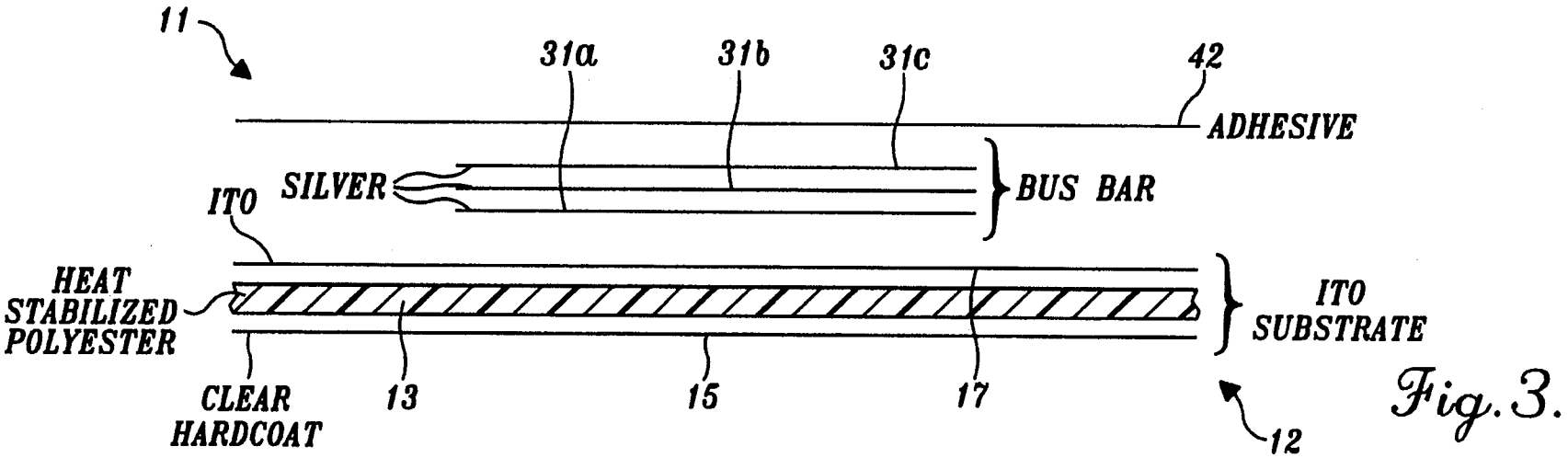
FIG. 3 is an exploded cross-sectional view of the optically clear overlay illustrated in FIG. 2 taken along line 3—3.
Figure 5:
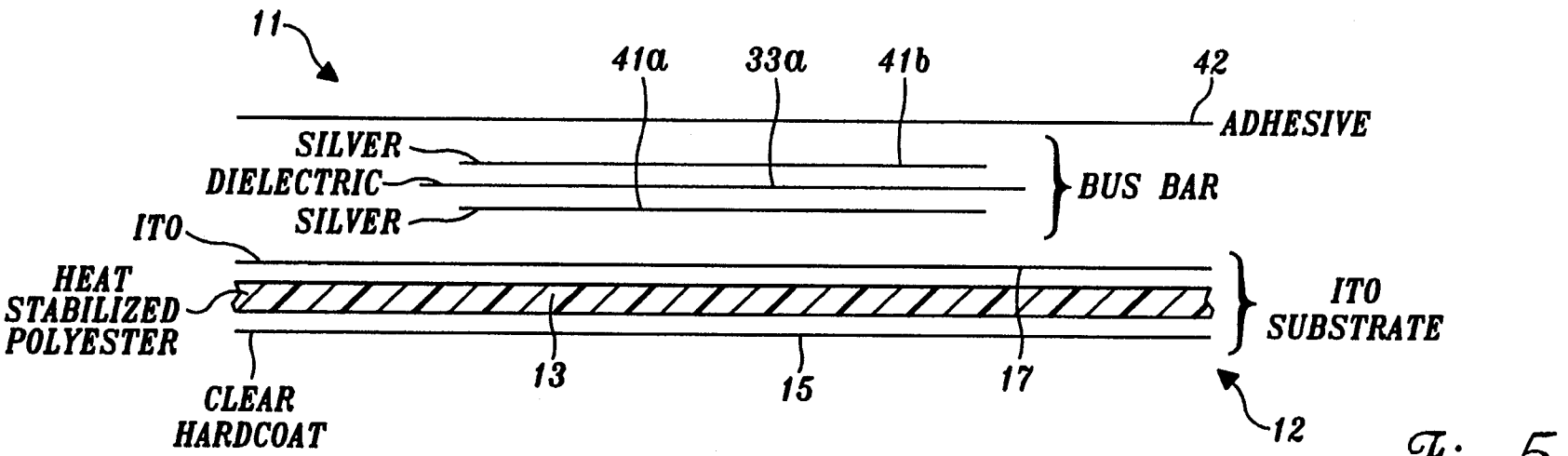
FIG. 5 is an exploded cross-sectional view of the optically clear overlay shown in FIG. 4 taken along line 5—5.

The present invention is directed to a window defogging system that comprises a power supply and an optically clear overlay. The optically clear overlay 11, as shown in FIGS. 3 and 5, includes an ITO substrate 12 formed by a sheet of heat-stabilized polyester 13 having a hard coat layer 15 on one surface and an indium tin oxide (ITO) layer 17 on the other surface. As will be better understood from the following description, when the optically clear overlay 11 is mounted on a window, the clear hard coat layer 15 faces away from the window. Thus, the clear hard coat provides a scratch-resistant protective cover for the sheet of heat stabilized polyester. The sheet of polyester is heat stabilized to prevent curling and distortion during subsequent processing.

Figure 1:
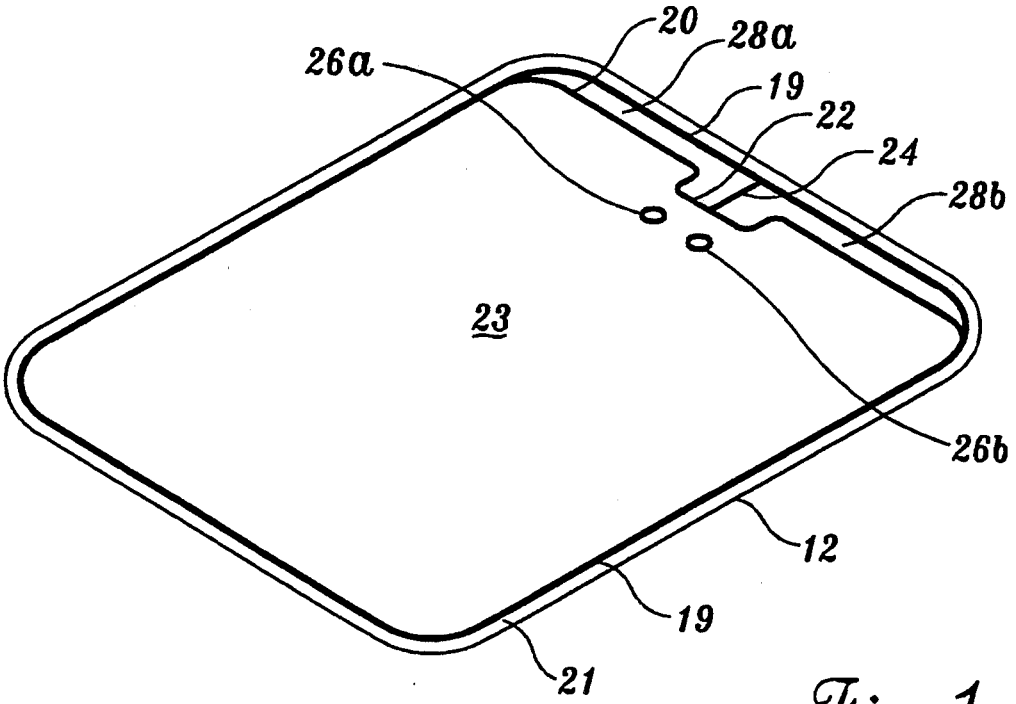
FIG. 1 is an isometric view of an ITO substrate that includes grooves for insulating the periphery and other regions of the ITO layer from an interior heating zone.

As shown in FIG. 1, the first step in the process of creating an optically clear overlay is to create a groove 19 in the ITO layer 17 around the periphery of the ITO substrate 12. Preferably, the groove is formed by scoring. If scoring is used, preferably, two parallel grooves are created. Alternatively, acid etching can be used to remove a portion of the ITO layer around the periphery of the ITO layer. The purpose of the groove 19 (or edge removal) is to electrically separate the edge 21 of the ITO layer 17 from an interior heating zone 23. At one end (the connector end) of the ITO substrate 12, an inner groove 20 is created parallel to the peripheral groove 19. Located at the center of the inner groove is a U-shaped inwardly extending groove 22. The inwardly extending groove 22 is divided by a short groove 24 that runs from the inwardly extending groove 22 to the peripheral groove 19. Finally, located in the interior heating zone 23 are a pair of circular grooves **26*a* and 26*b* that electrically isolate circular areas from the remainder of the interior heating zone 23. Again, if scoring is the method used to create the grooves, preferably, each groove consists of two score lines. Alternatively, the ITO regions 28*a* and 28*b* surrounded by the peripheral groove 19, the inner groove 20, the inwardly protruding groove 22 and the short groove 24 can be entirely removed by acid etching. Likewise, the ITO regions defined by the circular grooves 26*a* and 26*b*** can be entirely removed by acid etching.

The ITO regions **28*a* and 28*b* surrounded by part of the peripheral groove 19, the inner groove 20, the inwardly protruding groove 22, and the short groove 24 are isolated from the interior heating zone 23. As will be better understood from the following description, the isolated ITO regions 28*a* and 28*b* support a portion of bus bars that apply electrical power to the interior heating zone 23. As will be better understood from the following description, because the isolated ITO regions 28*a* and 28*b* are isolated from the interior heating zone and from one another, electrical current does not flow through these regions. An alternative to creating (or entirely removing) the isolated ITO regions 28*a* and 28*b*** is to overlay the related areas of the ITO with a dielectric layer.

Figure 2:
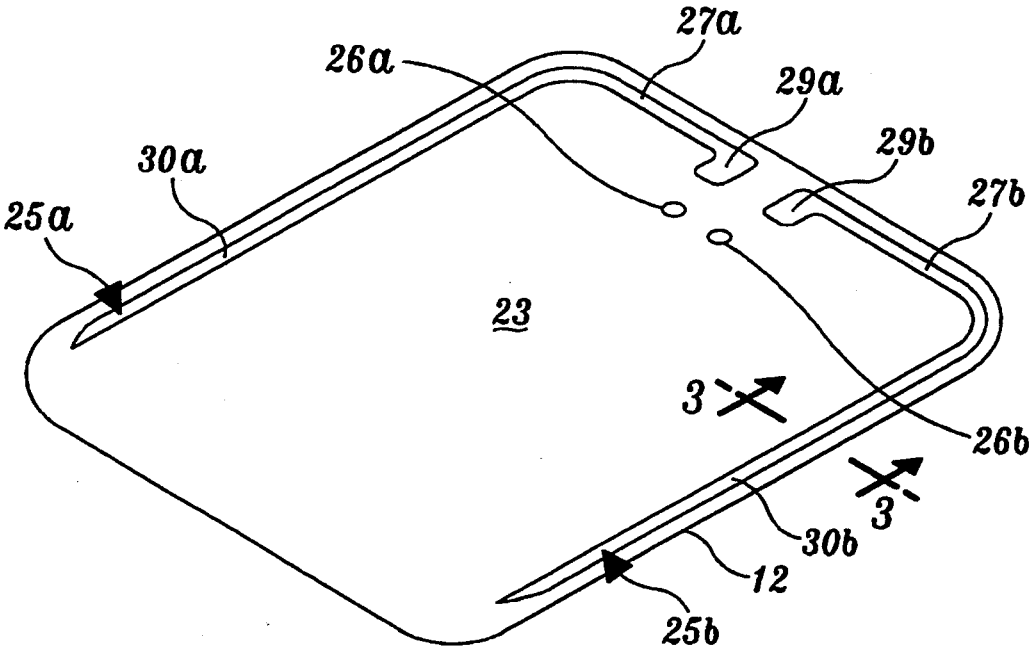
FIG. 2 is an isometric view of an optically clear overlay comprising an ITO substrate of the type illustrated in FIG. 1 supporting a pair of bus bars formed by printing multiple layers of silver on the substrate.

As illustrated in FIG. 2, after grooves (which are not shown in FIG. 2 for ease of illustration) are created in the ITO layer, in the manner shown in FIG. 1 (or the ITO regions are removed or a dielectric layer is created) bus bars are formed atop the ITO layer. In accordance with one version of the invention, shown in FIGS. 2 and 3, bus bars **25*a* and 25*b* are created by printing multiple layers of conductive silver along the periphery of the opposed edges of the interior heating zone 23 that lie transverse to the end of the ITO substrate 12 that contains the isolated ITO regions 28*a* and 28*b*. At the end of the ITO substrate 12 that contains the isolated ITO regions 28*a* and 28*b*, the bus bars extend inwardly, toward one another. The bus bars end at spaced apart terminal regions 29*a* and 29*b*. Thus, the bus bars are L-shaped and comprise long legs 25*a* and 25*b*, inwardly extending short legs 27*a* and 27*b*, and terminal regions 29*a* and 29*b*. The long legs 25*a* and 25*b* are, of course, located inwardly of the peripheral groove 19 illustrated in FIG. 1 and described above. Thus, the bus bars are isolated from the peripheral edges of the ITO substrate 11. Further, the short legs 27*a* and 27*b* and the terminal regions 29*a* and 29*b* lie atop the isolated ITO regions 28*a* and 28*b*. Thus, the short legs and the terminal regions and isolated from the inner heating zone 23** and from one another.

Rather than comprising a single layer of silver, as clearly shown in FIG. 3, each bus bar comprises multiple layers of silver **31*a*, 31*b*, and 31*c***. Multiple layers are used because 1 mil is the maximum thickness of silver that can be applied using conventional screen printing processes. A 1 mil silver bus bar has inadequate current-carrying abilities for use in a commercially acceptable version of the invention. Three layers of silver create a bus bar having a 3 mil thickness, which is normally adequate except in extremely large versions of the invention. Obviously, additional layers can be applied if desired or, in some versions of the invention, two layers may prove to be adequate.

Because bus bars of the embodiment of the invention illustrated in FIGS. 2 and 3 extend along the entire length of opposed sides of the interior heating zone 23, the voltage at the far end of the long legs 30*a* and 30*b* of the bus bars may be slightly less than the voltage at the point where the ends of the long legs join the short legs 27*a* and 27*b* when power is applied to the terminal regions in the manner hereinafter described. The voltage difference is, of course, due to the voltage drop along the length of the bus bar. The drop in voltage can result in a slightly decreased current flow through the ITO located between the remote ends of the long legs 30*a* and 30*b* when compared to the current flow through the ITO located between the points where the short and long legs meet. The differential in current flow through the ITO can decrease the heat generated between the related ends of the optically clear overlay 11.

Figure 4A:
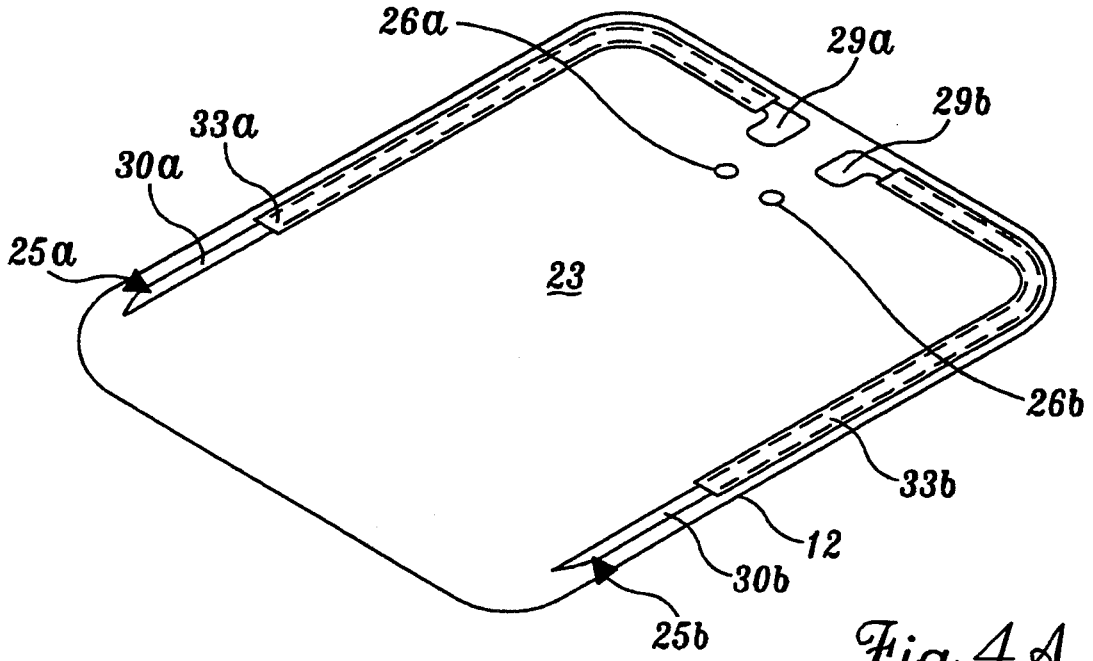
FIGS. 4A and 4B illustrate the creation of an optically clear overlay comprising an ITO substrate of the type illustrated in FIG. 1 supporting a pair of bus bars formed by printing multiple layers of silver, interleaved along part of their length with a dielectric layer, on the substrate.
Figure 4B:
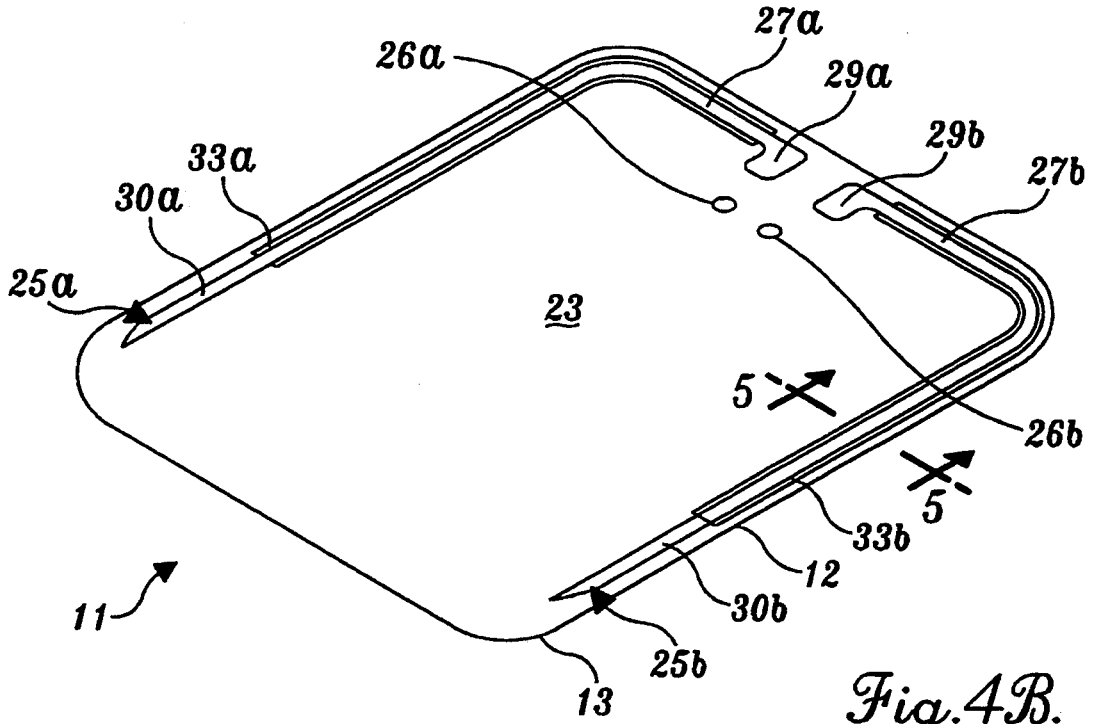

The just described voltage drop and the resulting heat differential can be reduced, if not entirely eliminated, by adding a dielectric in the manner illustrated in FIGS. 4A and 4B and 5 between the layers of silver as the optically clear overlay 11 is being created. More specifically, as illustrated in FIG. 4A, after the first (or second) silver layer 41*a* are printed to form the bus bars 25*a* and 25*b*, a layer of dielectric 33*a* and 33*b* is laid atop a part of the silver layers of each bus bar. The dielectric layers are slightly wider than the width of the bus bars. The dielectric layers 33*a* and 33*b* start at a position near the terminal regions 29*a* and 29*b* of the bus bars 25*a* and 25*b* and extend along the bus bars, terminating a substantial distance from the remote ends of the long legs 30*a* and 30*b* of the bus bars. Thereafter, as shown in FIG. 4B, one or more additional layers of silver 41*b* are printed both atop the previously printed layers of silver and atop the dielectric layers 33*a* and 33*b*. Thus, the additional layer(s) of silver extend from the terminal regions 29*a* and 29*b* to the remote ends of the long legs 30*a* and 30*b* of the bus bars 25*a* and 25*b*. As a result, some of the power applied to the terminal regions 29*a* and 29*b* of the bus bars in the manner hereinafter described flows directly to the remote ends of the long legs 30*a* and 30*b* of the bus bars 25*a* and 25*b*. As with first embodiment of the invention, power is also supplied along the length of the long legs of the bus bars starting at the point where the short legs 27*a* and 27*b* of the bus bars 25*a* and 25*b* join the long legs 30*a* and 30*b*. In essence, power is applied to both ends of the portion of the long legs of the bus bars that underlie the dielectric layers 33*a* and 33*b*.

Figure 7A:
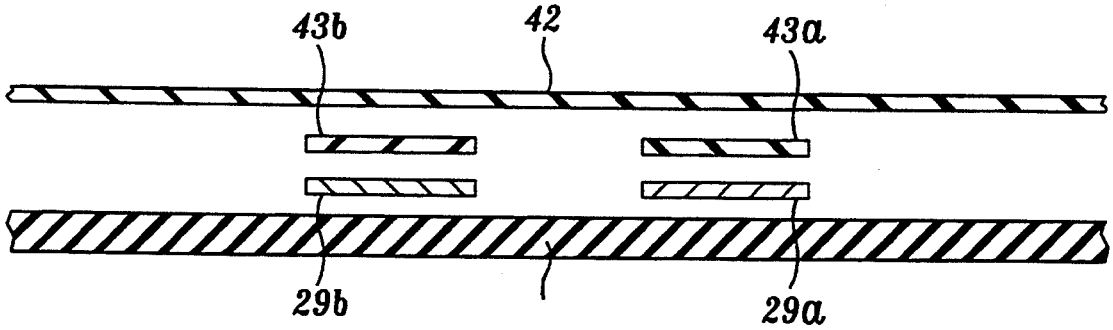
FIGS. 7A–C is a sequence of views illustrating the mounting of terminals in the regions illustrated in FIG. 6.
Figure 7B:
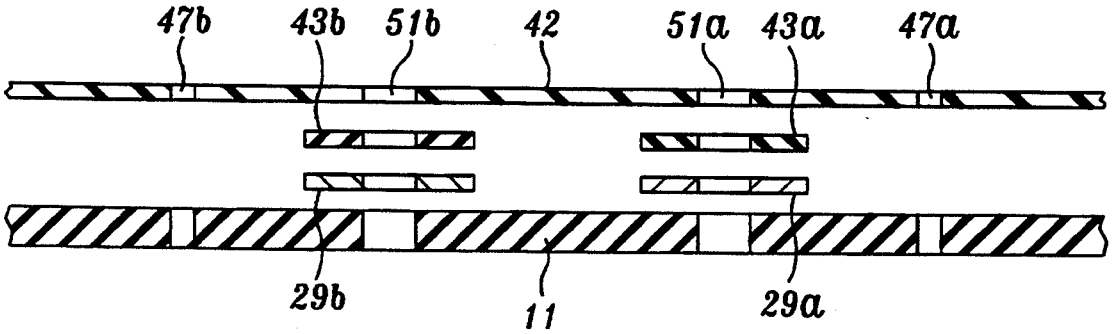

As shown in FIGS. 3 and 5, after the bus bars are created, a layer of adhesive 42 is applied atop the ITO side of the ITO substrate 11. The adhesive is sized to cover the entire ITO substrate 12. That is, the adhesive layer 42 extends to the edges of the ITO substrate 12. Thus, the adhesive covers the bus bars and the internal heating zone 23, as well as the part of the ITO substrate 12 extending beyond the peripheral groove 19. Prior to applying the layer of adhesive, as shown in FIG. 7A, masks 43*a* and 43*b* are laid atop the terminal regions 29*a* and 29*b* of the bus bars 25*a* and 25*b*. Masks 45*a* and 45*b* are also laid atop the isolated regions defined by the circular grooves 24*a* and 24*b* that were created in the ITO substrate 12 along with the other grooves as described above.

After the adhesive layer is applied, along with a suitable peel-off protective layer (not shown) L-shaped die cuts 47*a*, 47*b*, and 49*a* and 49*b* are made around the masks. The L-shaped die cuts are oriented such that the apexes of the angles formed by the L-shaped die cuts all point toward a central area. Thereafter, or simultaneously with the creation of the L-shaped die cuts, holes are cut through the terminal regions 29*a* and 29*b* of the bus bars 25*a* and 25*b* as well as the overlying masks 43*a* and 43*b*, the adhesive layer 42 and the ITO substrate 12. Holes are also cut through the center of the circular grooves 26*a* and 26*b*, as well as the overlying masks 45*a* and 45*b*, the adhesive layer 42, and the ITO substrate 12.

Figure 7C:
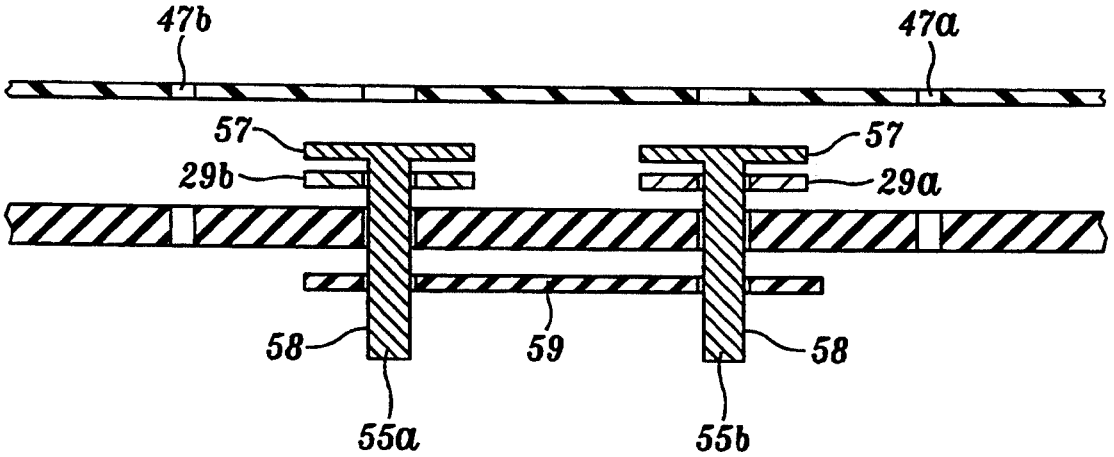

After the holes are cut, the flaps created by the die cuts 47*a*, 47*b*, 49*a*, and 49*b* are raised, the masks 43*a*, 43*b*, 45*a* and 45*b* are removed and threaded terminals are inserted through the holes and pressed into place. As shown in FIG. 7C, the threaded terminals 55*a* and 55*b* include relatively flat heads and threaded shanks that are swaged near their base.

The terminals are mounted such that the flat heads 57 of the related terminals 55*a* and 55*b* press against the surfaces of the terminal regions 29*a* and 29*b* of the bus to be in electrical contact therewith. A dielectric plate 59 is mounted over the studs 58 of the terminals 55*a* and 55*b*.

Similar terminal elements (not shown) provided solely for mechanically supporting the housing of a power supply 61, shown in FIG. 8 and described next, are mounted in the holes 53*a* and 53*b* that extend through the regions defined by the circular grooves 26*a* and 26*b*. The diameter of the heads of the latter terminals is, of course, smaller than the diameter of the regions defined by the circular grooves 26*a* and 24*b*. As a result, no electrical contact occurs between the terminals and the central heating zone 23.

Figure 8:
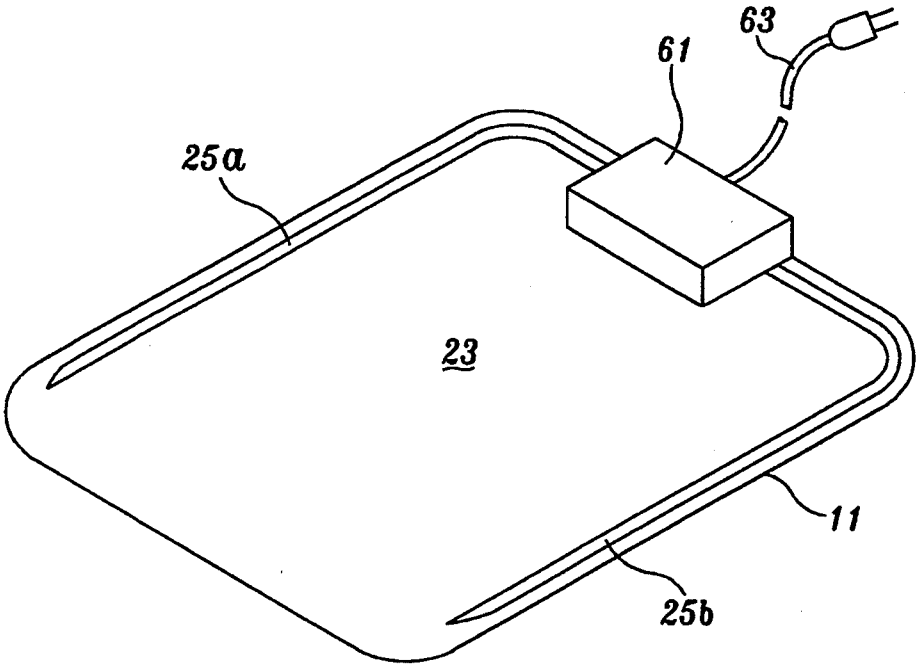
FIG. 8 is a perspective view illustrating a window defogger system formed in accordance with the invention by a power supply and an optically clear overlay of the type shown in FIGS. 2–7.

As shown in FIG. 8, an electrical power supply housing 61 is attached to the optically clear overlay 11 by the terminals that extend outwardly from the ITO substrate 12. As a result, temperature-sensing elements mounted in the housing 61 in FIG. 8 (not shown) are positionably in direct contact with the interior heating zone 23 of the ITO substrate 11. In this regard, in addition to the one or more temperature-sensing elements, the housing 61 houses a feed-back temperature control circuit connected to a suitable AC or DC power source via a cable 63. Preferably, the housing includes a heat sink that allows the wires connected to the temperature-sensing elements of the control circuit to be heated by the ITO substrate to the same temperature as the temperature-sensing elements to avoid any control system problems that might be created by thermal delay.

Figure 9:
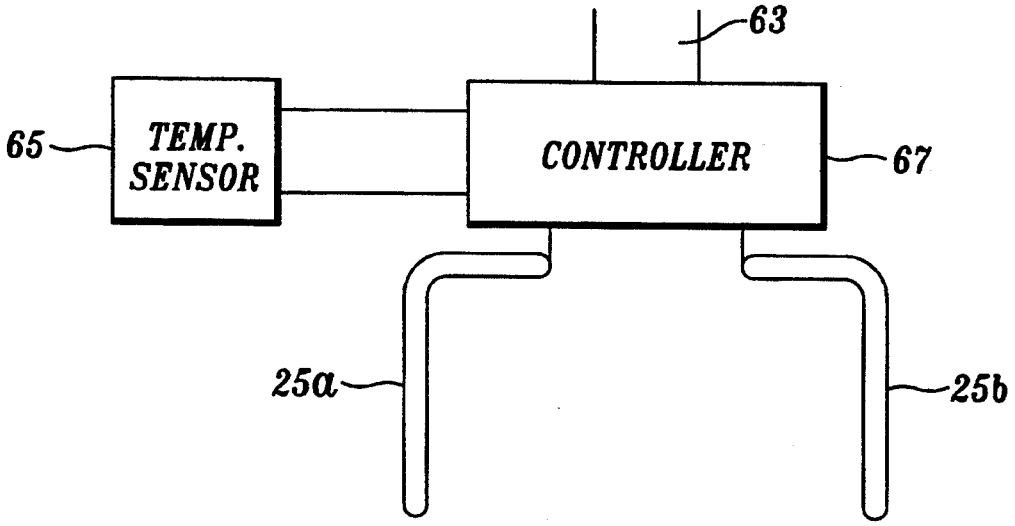
FIG. 9 is a block diagram of a power supply suitable for use in the window defogger system illustrated in FIG. 8.

FIG. 9 illustrates a power supply suitable for use in a window defogging system formed in accordance with the invention. The power supply includes a temperature sensor 65, such as a thermistor, and a controller 67. The controller 67 controls the application of power to the bus bars 25*a* and 25*b* in a feedback manner based on the temperature sensed by the temperature sensor 65.

Figure 6:
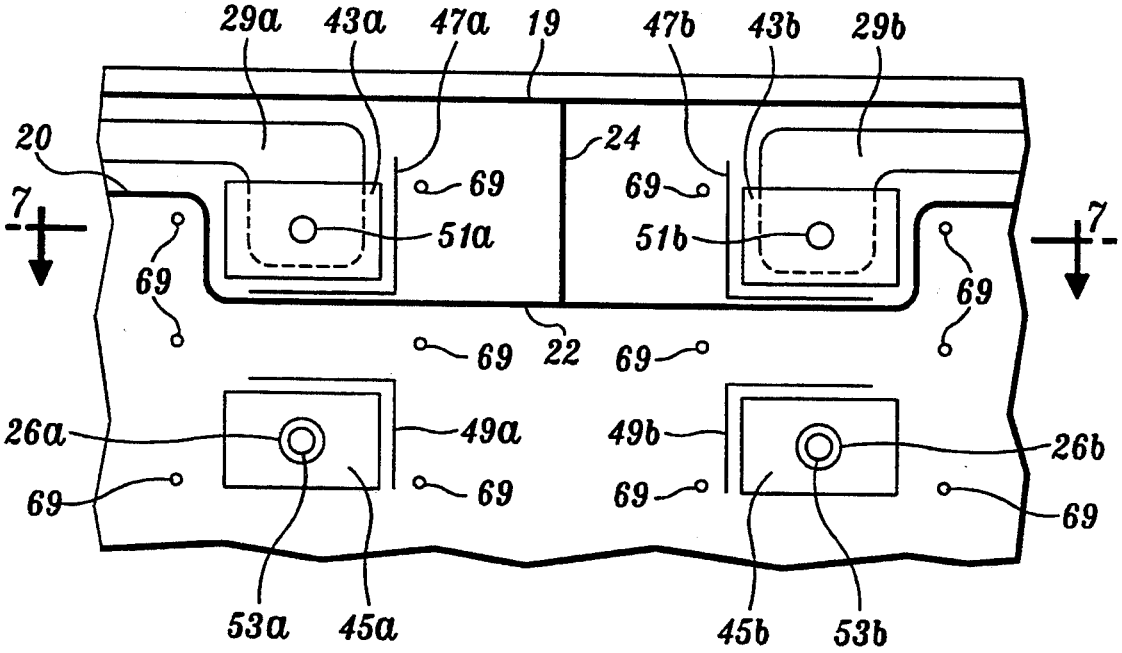
FIG. 6 is a plan view of the region in the vicinity of the terminal ends of the bus bars illustrated in the embodiments of the invention illustrated in FIGS. 1–5.

The optically clear overlay 11 is mounted on the interior surface of a window to be defogged by first cleaning the window and, then, coating the window with a suitable wetting agent. Then, the release paper (not shown) covering the adhesive layer is removed and the optically clear overlay positioned on the wetting agent such that the adhesive layer is juxtaposed against the window. The wetting agent allows the optically clear overlay to be positioned. Then, the wetting agent is forced from between the window and the overlay using a squeegee. In this regard, preferably, small holes 69 (FIG. 6) are located in the vicinity of the terminals to help in the removal of the wetting agent. After the wetting agent and all air bubbles have been removed, the adhesive is allowed to set. Then the power supply housing 61 is mounted, using the terminals.

While preferred embodiments of the invention have been illustrated and described, it will be appreciated that various changes can be made therein without departing from the spirit and scope of the invention. Consequently, within the scope of the appended claims, it is to be understood the invention can be practiced otherwise than as specifically described herein.

The embodiments of the invention in which an exclusive property or privilege is claimed are defined as follows:

1. A window defogger system comprising:

(a) a power supply mounted in a housing; and (b) an optically clear overlay suitable for positioning on one surface of a window to be defogged, said optically clear overlay comprising:

(i) an indium tin oxide (ITO) substrate including a sheet of heat stabilized polyester, a hard coat layer on one surface of said sheet of heat stabilized polyester and an ITO layer located on the other surface of said sheet of heat stabilized polyester, said ITO layer including means for electrically isolating the edge of said ITO layer from an interior heating zone;

(ii) a pair of bus bars located along opposing edges of said interior heating zone, said bus bars being formed of multiple layers of silver deposited atop said ITO layer; and (iii) attachment means for mounting said power supply housing on said optically clear overlay and connecting said bus bars to said power supply.

2. The window defogging system claimed in claim 1 wherein said means for electrically isolating the edge of said ITO layer from an interior heating zone comprises a peripheral groove formed on the periphery of said ITO layer.

3. The window defogging system claimed in claim 1 including a dielectric layer located between said multiple layers of silver of each of said bus bars along a part of the length of said bus bars.

4. The window defogging system claimed in claim 1 wherein said bus bars are L-shaped and oriented such that the one leg of each of said bus bars is located along one of said opposing edges of said interior heating zone and the other legs extend toward one another.

5. The window defogging system claimed in claim 4 including a dielectric layer located between said multiple layers of silver of each of said bus bars along a part of the length of said bus bars.

6. The window defogging system claimed in claim 4 wherein said other legs of said L-shaped bus bars are electrically isolated from said interior heating zone.

7. The window defogging system claimed in claim 6 including a dielectric layer located between said multiple layers of silver of each of said bus bars along a part of the length of said bus bars.

8. The window defogging system claimed in claim 6 wherein said other legs of said L-shaped bus bars are electrically isolated from said interior heating zone by grooves in said ITO layer that surround said other legs.

9. The window defogging system claimed in claim 8 including a dielectric layer located between said multiple layers of silver of each of said bus bars along a part of the length of said bus bars.

10. The window defogging system claimed in claim 8 wherein said attachment means includes a plurality of terminals extending orthogonally outwardly from said ITO substrate.

11. The window defogging system claimed in claim 10 wherein one of said plurality of terminals is electrically connected to each of said bus bars.

12. The window defogging system claimed in claim 11 wherein said terminals that are electrically connected to said bus bars are connected to the ends of said other legs of said bus bars remote from said legs that are located along opposing edges of said interior heating zone.

13. The window defogging system claimed in claim 1 wherein said attachment means includes a plurality of terminals extending orthogonally outwardly from said ITO substrate.

14. The window defogging system claimed in claim 13 wherein one of said plurality of terminals is electrically connected to each of said bus bars.

15. A process for creating an optically clear overlay suitable for use in a window defogging system comprising the steps of:

electrically isolating the edge of an ITO layer located on one surface of a sheet of heat stabilized polyester from an interior heating zone;

creating bus bars formed of multiple layers of silver along opposing edges of said interior heating zone; and creating a connecting mechanism for electrically connecting said bus bars to a power source such that the housing of said power source is supported by said optically clear overlay.

16. The process claimed in claim 15 wherein said step of electrically isolating the edge of an ITO layer from an interior heating zone comprises creating a groove in said ITO layer adjacent to the periphery of said ITO layer.

17. The process claimed in claim 15 including the step of adding a layer of dielectric between the multiple layers of silver that create said bus bars along a part of the length of said bus bars.

18. The process claimed in claim 15 wherein said bus bars have an L-shaped configuration and are oriented such that one leg of each of said bus bars is located along one of said opposing edges of said interior heating zone and the other legs extend toward one another.

19. The process claimed in claim 18 including the step of adding a layer of dielectric between the multiple layers of silver that create said bus bars along a part of the length of said bus bars.

20. The process claimed in claim 18 including the step of electrically isolating said other legs of said bus bars from said interior heating zone.

21. The process claimed in claim 20 including the step of adding a layer of dielectric between the multiple layers of silver that create said bus bars along a part of the length of said bus bars.

22. The process claimed in claim 20 wherein said other legs of said bus bars are isolated from said interior heating zone by grooves in said ITO layer that surround said other legs.

23. The process claimed in claim 22 including the step of adding a layer of dielectric between the multiple layers of silver that create said bus bars along a part of the length of said bus bars.

* * * * *